US009770144B2

(12) United States Patent
Rife et al.

(10) Patent No.: US 9,770,144 B2
(45) Date of Patent: Sep. 26, 2017

(54) TOILET

(71) Applicants: Robert Rife, Mt. Pleasant, SC (US); Leah Vining, Evans, GA (US)

(72) Inventors: Robert Rife, Mt. Pleasant, SC (US); Leah Vining, Evans, GA (US)

( * ) Notice: Subject to any disclaimer, the term of this patent is extended or adjusted under 35 U.S.C. 154(b) by 101 days.

(21) Appl. No.: 15/014,192

(22) Filed: Feb. 3, 2016

(65) Prior Publication Data

US 2017/0055789 A1 Mar. 2, 2017

Related U.S. Application Data

(60) Provisional application No. 62/209,938, filed on Aug. 26, 2015.

(51) Int. Cl.

| | |
|---|---|
| ***A47K 13/00*** | (2006.01) |
| ***A47K 13/10*** | (2006.01) |
| ***A47K 11/04*** | (2006.01) |
| ***A47K 13/24*** | (2006.01) |

(52) U.S. Cl.
CPC ..... *A47K 13/10* (2013.01); *A47K 11/04* (2013.01); *A47K 13/24* (2013.01)

(58) Field of Classification Search
CPC ..... A47K 13/10
USPC ..... 4/237
See application file for complete search history.

(56) References Cited

U.S. PATENT DOCUMENTS

| | | | |
|---|---|---|---|
| 4,587,678 | A | 5/1986 | Love et al. |
| 4,795,176 | A | 1/1989 | Harrigan et al. |
| 5,279,000 | A | 1/1994 | Mercier et al. |
| 5,309,583 | A | 5/1994 | White et al. |
| 5,570,865 | A | 11/1996 | Godfrey |
| 5,945,914 | A | 8/1999 | Holmes et al. |
| 6,308,347 | B1 | 10/2001 | King |
| 6,398,305 | B1 | 6/2002 | Ball et al. |
| 8,866,620 | B2 | 10/2014 | Amir |
| 2009/0144891 | A1 | 6/2009 | Peng |
| 2010/0219668 | A1 | 9/2010 | Nelson |
| 2013/0082842 | A1 | 4/2013 | Balazs |

FOREIGN PATENT DOCUMENTS

| | | |
|---|---|---|
| JP | 11169406 | 6/1999 |

OTHER PUBLICATIONS

PCT International Search Report and Written Opinion, dated Sep. 26, 2016.

Brochure: LiftSeat Powered Toilet Lifts: The LS600 Bariatric Toilet Lift, 2006-2012.

(Continued)

*Primary Examiner* — Huyen Le

(74) *Attorney, Agent, or Firm* — B. Craig Killough; Barnwell Whaley Patteerson & Helms

(57) ABSTRACT

A toilet inhibits an occupant from exiting the toilet. Sensors positioned on the toilet detect the application of pressure on the toilet by an occupant that is consistent with an occupant attempting to exit the toilet, and/or movements of an occupant that are consistent with an occupant attempting to exit the toilet. The sensors cause an actuator to change the angle of the toilet seat, which inhibits exiting the toilet. The toilet may also be constructed to signal an attendant when actions by an occupant are consistent with actions indicating an attempt by the occupant to exit the toilet.

16 Claims, 4 Drawing Sheets

(56) References Cited

OTHER PUBLICATIONS

Wireless Telemetry System (WTS) for Load Cells and Torque Transducers, http://www.interfaceforce.com/index.php?mod=product&show=161&utm_source=bing, 2015.
What is a Load Cell? How do Load Cells Work?, http://www.loadstarsensors.com/what-is-a-load-cell.html, 2015.

TOILET

This application claims the benefit of Provisional Application Ser. No. 62/209,938 filed Aug. 26, 2015.

FIELD OF THE INVENTION

This invention relates to toilets generally, and is more specifically directed to a toilet that discourages users from exiting the toilet without assistance.

BACKGROUND OF THE INVENTION

Healthcare facilities, including nursing homes and hospitals, are increasingly aware of fall risks and the patients and residents who are more likely to fall while residing at a healthcare facility. One situation in which falls occur is when a person exits a toilet.

A person using a toilet in a healthcare facility or nursing home, and who is a fall risk, is given privacy while using the toilet. The person is instructed to request assistance before attempting to exit the toilet. However, people are frequently embarrassed to ask for assistance, and attempt to exit the toilet without assistance. Such persons may be at risk of falling due to age, medical condition, or medications, as they transition from a seated to a standing position.

There is a need for a device that will inhibit a person who is at risk of falling from attempting to stand or attempting to exit a toilet without assistance.

SUMMARY OF THE INVENTION

The present invention is a toilet that inhibits an occupant from exiting the toilet. Sensors positioned on the toilet detect the application of pressure on the toilet by an occupant that is consistent with an occupant attempting to exit the toilet, and/or movements of the occupant that are consistent with an occupant attempting to exit the toilet. The sensors cause an actuator to change the angle of the toilet seat, which inhibits exiting the toilet. The toilet may also be constructed to signal an attendant when actions by an occupant are consistent with actions indicating an attempt by the occupant to exit the toilet.

BRIEF DRAWING DESCRIPTION

DESCRIPTION OF PREFERRED EMBODIMENTS

The present invention is a toilet comprising one or more sensors that sense movements of an occupant that are indicative of a person attempting to exit a toilet. The sensors emit a signal that changes an angle of the seat of the toilet.

Upon actuation of one or more of the sensors, an angle of the seat of the toilet changes from generally horizontal to an angle that is not horizontal. In one embodiment, a top surface of the toilet changes from generally horizontal to an angle that is preferably not more than thirty degrees and more preferably not more than twenty two and a half (22½°) degrees from horizontal, with the front of the toilet seat, or portion of the toilet seat closer to the front of the toilet seat, elevated relative to the rear of the toilet seat. The change in angle increases the effort required to exit the toilet, and inhibits a user from exiting from the toilet, particularly where the user is of advanced age, or has limited strength or mobility, due to medical conditions or medications.

Figure 1:
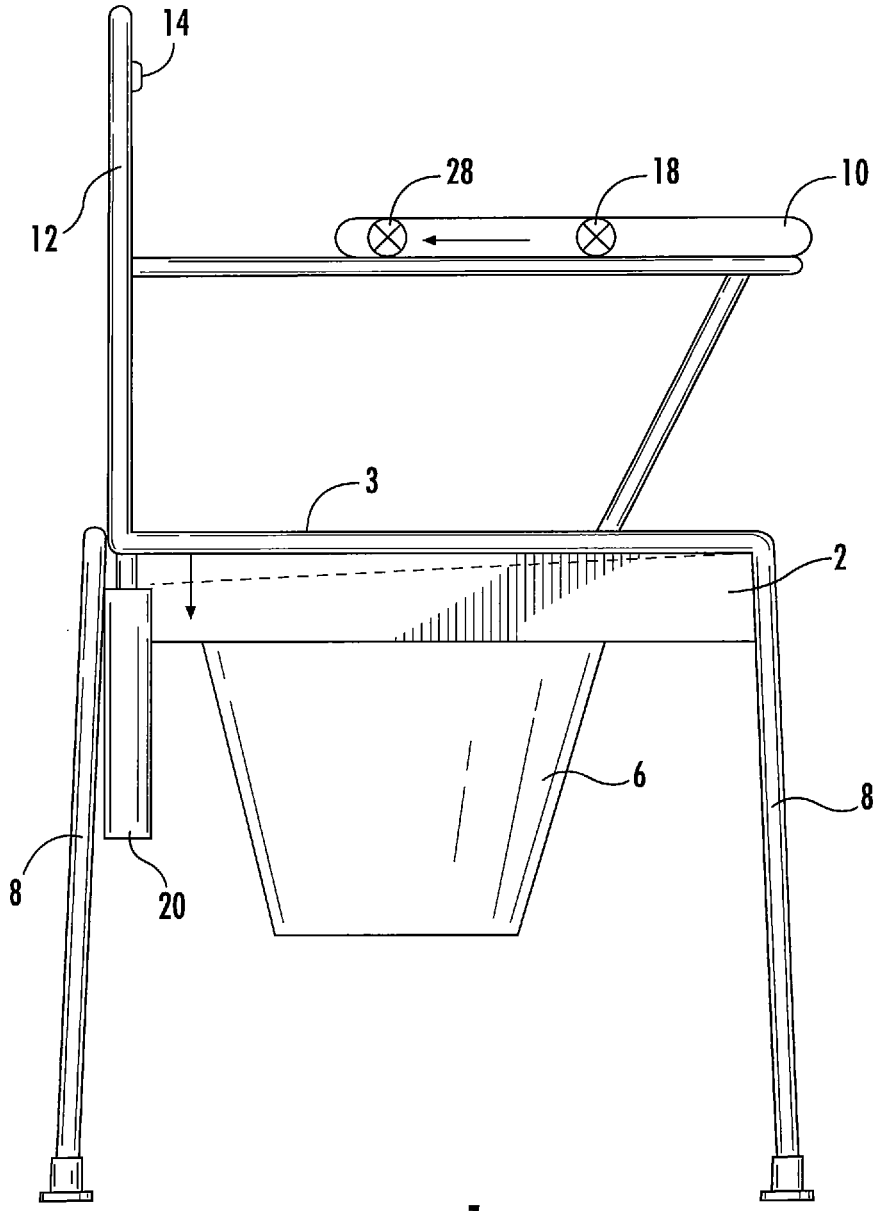
FIG. 1 is a side elevation of an embodiment of a toilet according to the invention.

In the embodiment shown in FIG. 1, a toilet similar to a portable toilet used in medical facilities and nursing homes is depicted. The toilet 2 has a seat 3, with an opening 4 in the seat that communicates with a receptacle 6 for waste material. The seat is elevated to an appropriate height by a plurality of legs 8, such as four legs. Arms 10 are spaced apart and are present on opposite sides of the toilet seat. The arms may extend upwardly from the toilet seat, providing an opening between the arms for access to the seat.

The arms may be connected to a back 12 that extends upwardly from a rear portion of the toilet. One or more sensors 14 are used that sense movement by an occupant that is consistent with a person attempting to exit the toilet. Such movements typically involve moving from a seated position to a standing position. For example, a person's back moving away from the back 12 of the toilet is an indication that the person may be attempting to stand. Typically, this movement also includes a person applying pressure to one or both of the arms 10 of the toilet, so as to push themselves from a seated position to a standing position.

Figure 2:
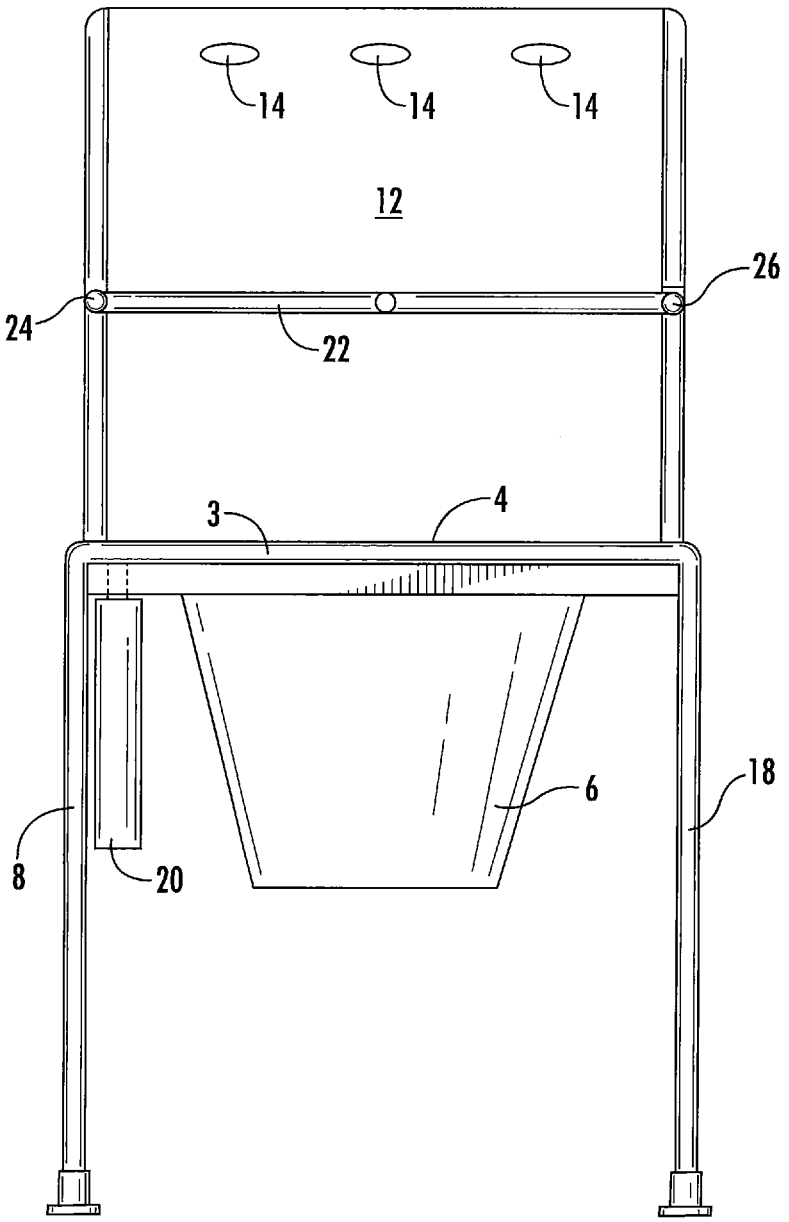
FIG. 2 is a front elevation of an embodiment of a toilet according to the invention.

Accordingly, in an embodiment, the toilet seat has sensors 14 in the back 12 of the seat that emit a radio frequency signal from a sending and receiving unit that measures movement away from the back and senses the distance of the user's back from the back 12 of the toilet. FIG. 2. Other sensor types that measure distance, such as distance measuring devices that use lasers, may be used as sensors 14. In one embodiment, when the user's back moves to a predetermined distance from a sensor or sensors 14, the back of the toilet seat moves downwardly relative to the front of the toilet seat to inhibit the person's attempt to exit or stand up. A signal may be emitted to an attendant as describe herein anytime that the toilet seat moves downwardly due to actuation by a sensor.

In another embodiment, one or more of the sensors 14 sense motion. The motion sensors are calibrated to actuate the actuator due to more movement by the user that is more than normal shifting about while seated.

In an embodiment, one or more pressure sensors 18 are located in the arms of the device. A plurality of spaced apart pressure sensors may be used, since different users will apply pressure to the arms in different places while attempting to stand up or exit the toilet. The pressure sensors are calibrated so that when pressure that is significant enough to indicate a user's attempt to stand or exit the toilet, the toilet seat moves to an inclined position as described herein to inhibit such movement.

Another change in pressure on the toilet that is indicative of a person attempting to stand is applying a force in a direction that is toward the rear of the toilet. In another embodiment, one or more pressure sensors 28, which may be load cells, are located in the arms of the device sense rearward pressure on the arms 10, as demonstrated by the arrow on the arm in FIG. 1. The pressure sensors 28 measure such rearward pressure and actuate the lowering of the rear of the toilet seat in response to the pressure. The pressure sensors are calibrated so that when pressure that is significant enough to indicate a user's attempt to stand or exit the toilet, the toilet seat inclines to inhibit such movement. The pressure sensors 28 are preferred to be used with pressure sensors 18, but may be used independently of each other.

The dotted line and vertical arrow in FIG. 1 demonstrate exemplary movement of the toilet seat 3. A change of the angle of the toilet seat 3 from substantially horizontal to an incline, with the rear of the toilet seat lower than the front of the toilet seat, or a portion of the toilet seat that is closer to the front, may be accomplished by hinging a portion of the toilet seat so that it pivots. The actuator 20 may be an air or hydraulic cylinder that may be used to pull the rear of the toilet seat down in response to movement of the user, and/or pressure applied to the arms of the toilet as described above. The actuator's normal position holds the seat and occupant in a generally horizontal position.

In another embodiment, the actuator 20 may be an electrically powered actuator. An electric motor with rack and pinion gear may be used as an actuator to lower the seat. The electric motor may be powered by a battery, particularly where portability of the toilet is desired.

The actuator 20 may be extended to support the toilet seat 3 in a generally horizontal position under normal use, but upon receiving a signal from a motion sensor, pressure sensor or other sensor, or a combination, the actuator retracts so as to pull the rear of the hinged toilet seat downwardly. The toilet seat is repositioned at an angle, which is preferred to not to exceed thirty degrees from horizontal and is more preferred to not exceed twenty two and a half (22½°) degrees from horizontal. The incline of the toilet seat will inhibit, although not necessarily prevent, a user from standing or exiting the toilet.

In another embodiment, lowering of the rear of toilet seat 3 may be terminated if the sensor or sensors that have initiated actuation of the actuator 20 sense that movement by the user is terminated. For example, if pressure on the arms is terminated, or movement away from the seat back is terminated and the user moves his or her back against the seat back, movement of the rear of the seat may be terminated at less than full downward movement.

In another embodiment, upon sensing that movement is terminated, the seat returns to its original position, or alternatively, only if the user's back is positioned against the seat back as sensed by sensors 14 does the seat return to its original position. In these embodiments, the device is preferred to again lower the rear of the seat if movement is sensed.

In a preferred embodiment, actuation of one or more of the sensors also actuates an alert provided to an attendant so that help is summoned to the toilet and to the user of the toilet. Such alert may be an audible or visual signal 40 provided at a central location, such as a nurse's station, or a signal that is provided to a mobile telephone or other receiving device. A call button 30 may be positioned on the device so that the user may intentionally press the button to seek assistance. Wireless communications may be used to alert an assistant.

In another embodiment, the actuator for the seat is actuated by a mechanical switch. For example, a barrier, such as crossbar 22, is positioned between the arms at the front of the toilet. FIG. 2. The barrier may be pivotally mounted 26 at one end of the barrier. In yet another embodiment, two barriers or crossbars are used, with one barrier pivotally mounted to each of the arms. If the user attempts to exit the toilet by pushing the barrier away from the opening, a crossbar sensor senses movement of the barrier. The crossbar sensor 24 may be a switch that initiates actuation of the actuator 20. Actuating the crossbar sensor by pushing against it could lock the crossbar from further movement, preventing the occupant from exiting the toilet. However, it is not deemed to be desirable to have a locking bar which would inhibit a person from exiting the toilet. A bar that locks or has significant resistance could result in the user feeling imprisoned.

In another embodiment, the actuator may be mounted to push or lift the back of the seat above the front of the seat in order to assist exiting the toilet. In this embodiment, the maximum angle of the seat is limited to a maximum of about 30° from horizontal, and is more preferably limited to about 22½°, from horizontal. Lifting the rear of the toilet seat 3 relative to the front is preferred to be actuated by a switch or other actuation device to which the user of the toilet does not have access while occupying the toilet. Actuation of this feature is preferred to be available only when an assistant is present. Actuation may be provided by a switch that communicates with the actuator 20, such as a mechanical switch or a wireless remote communications device.

Figure 3:
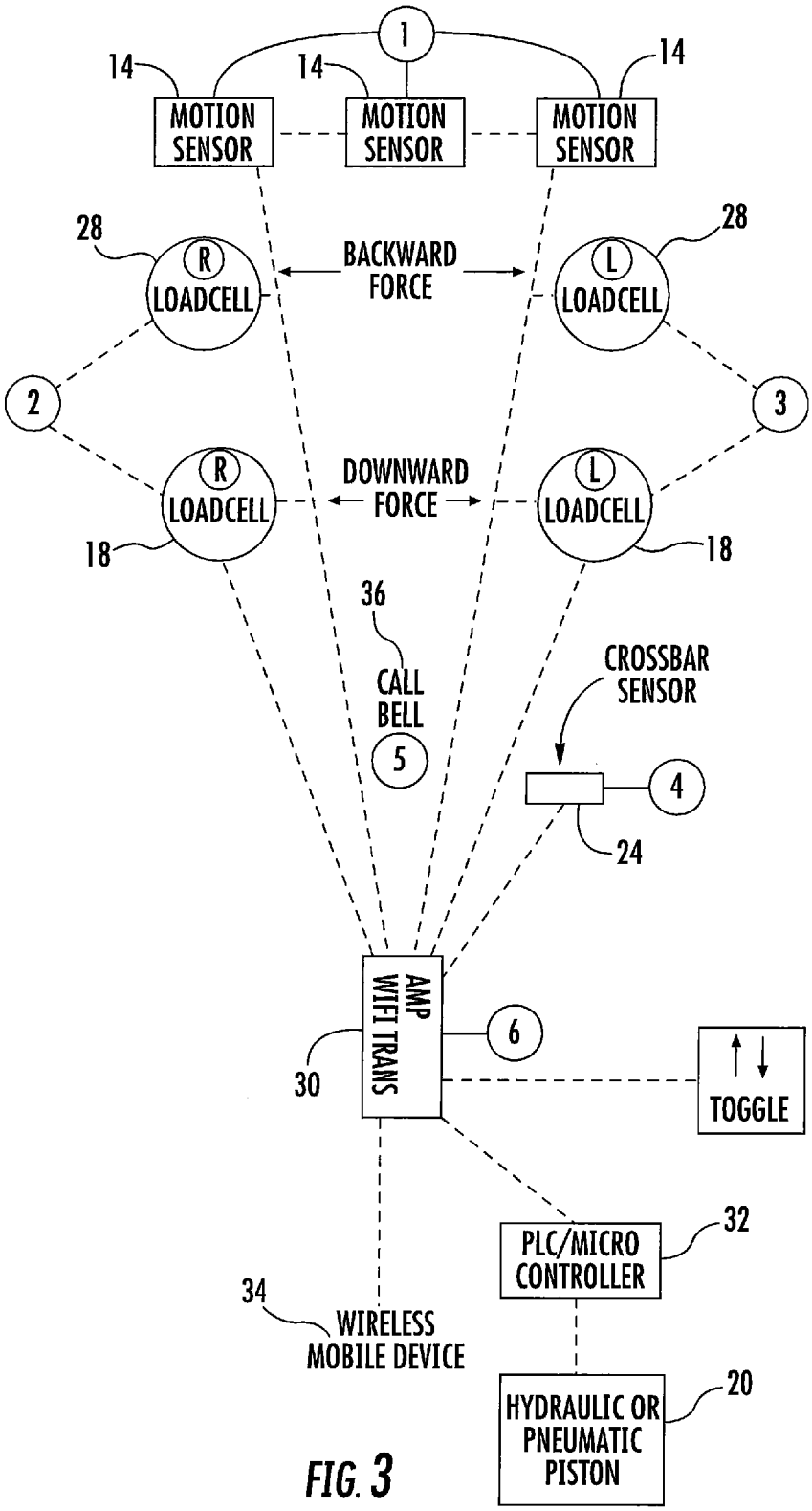
FIG. 3 is a schematic illustration of an interaction of various sensors according to an embodiment of the invention.
Figure 4:
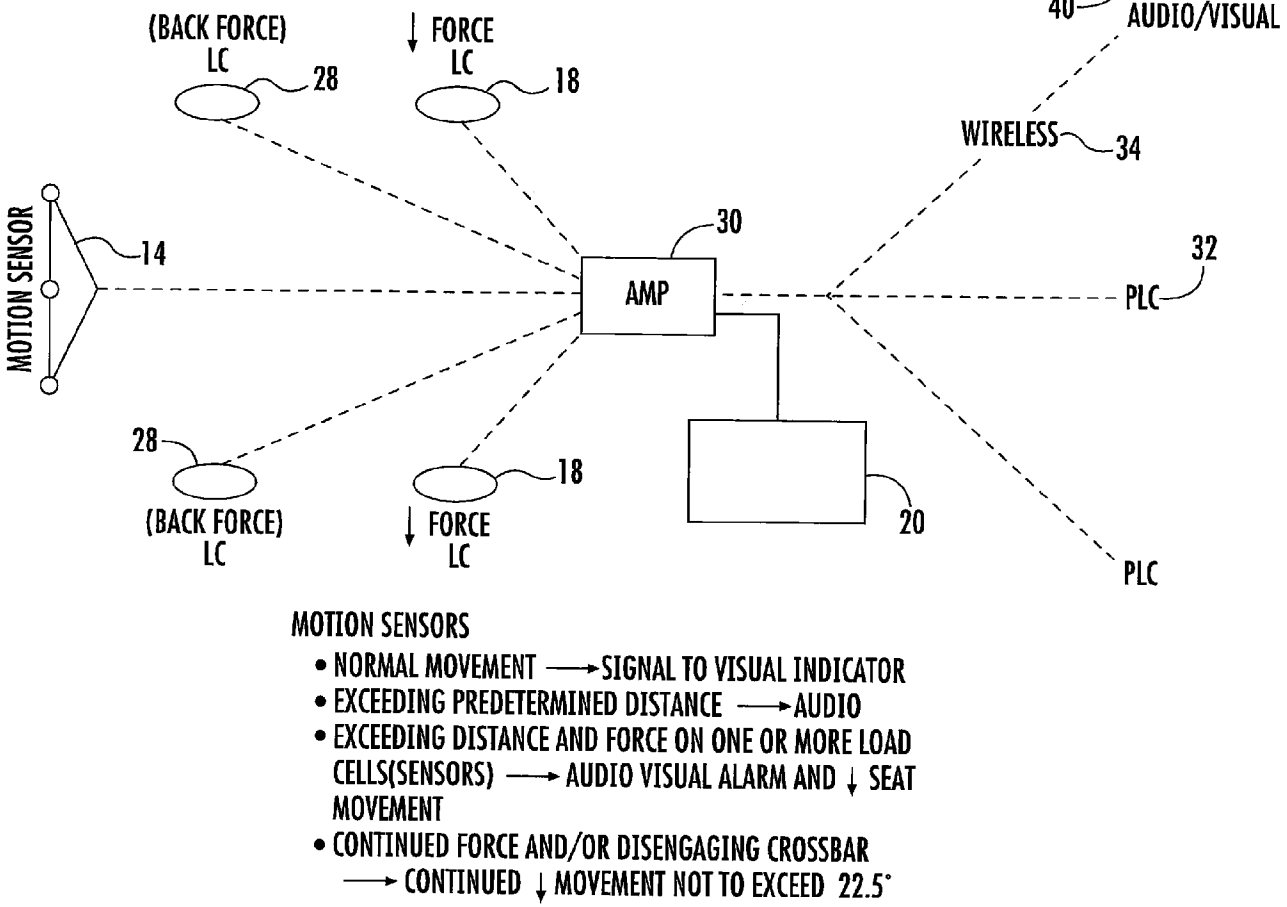
FIG. 4 is an additional schematic illustration of the interaction of various sensors according to an embodiment of the invention.

FIG. 3 and FIG. 4 demonstrate the interrelationship of the electromechanical features of the invention according to an embodiment of the invention. The motion or distance sensors 14, load cells 18, and crossbar sensor 24 communicate with a wireless transmitter that may include a signal amplifier. Communications may be via a local area wireless computer networking technology (Wi-Fi) connective devices, or devices that provide short range wireless communications, including but not limited to those communications devices operating at frequencies between 2402 and 2480 MHz, or 2400 and 2483.5 MHz, such as Bluetooth® devices. The wireless transmitter 30 may be connected to a microcomputer 32 that actuates the actuator 20. The wireless transmitter may also actuate an audible or visual signal, which is demonstrated by the call bell 36 in FIG. 3. The wireless transmitter may also communicate conditions of the sensors and the toilet to a wireless mobile device 34 such as a smartphone.

As shown in an embodiment of FIG. 4, exceeding force levels or movement sensed by the sensors actuates signaling (audio and/or visual) and/or operation of the actuator 20. The use of one or more programmable logic controllers (PLC) allows the force on the sensors such as the load cells to be programmed as required. Some users, due to size or physical condition, will require more or less sensitivity on the sensors, which may be varied by the use of the programmable logic controllers.

Load cells may be used as sensor for sensing pressure as stated herein. A load cell is a transducer that creates an electrical signal whose magnitude is positively related to the magnitude of force applied. Some load cells measure deformation due to load and produce the electrical signal, such as strain gauge and piezo-electric load cells. The load cells 18 produce an electrical signal that actuates the movement of the seat when the force exceeds a preset level. Normal arm pressure from the user's movement while sitting on the toilet does not result in actuation of the sensors or the actuator, but pushing down on the arms, or pushing the arms toward the rear, as the occupant attempts to exit the toilet increases the magnitude of the signal generated by the load cell to a threshold that causes movement of the toilet seat as described herein. The threshold may be variable as required for the application of the toilet.

In one embodiment, the device does not have a receptacle 6 as shown in FIGS. 1 and 2. Rather, the toilet is positioned over an existing permanent toilet. The opening 4 in the seat 3 communicates with the opening in the plumbed in toilet, and is positioned over the permanent, plumbed in toilet. With a receptacle 6 in place as shown in FIG. 1, the device may be used in close proximity to a bed, so that a limited mobility user need only travel a short distance to use the toilet.

What is claimed:

1. A toilet, the toilet comprising:

a seat having an opening therein;

a seat back connected to the seat;

a pair of spaced apart arms positioned above the seat;

an actuator that moves the seat to an inclined position wherein a rear portion of the seat is lower than a front portion of the seat upon the actuator receiving a signal;

a first pressure sensor positioned in a first arm of the pair of spaced apart arms; and a second pressure sensor positioned in a second arm of the pair of spaced apart arms;

wherein, in use, pressure applied to the first pressure sensor or the second pressure sensor transmits the signal to the actuator, whereupon the actuator moves the seat to the inclined position.

2. A toilet as described in claim 1, further comprising a seat back sensor positioned in the seat back, wherein, in use, the seat back sensor detects a change in distance of an occupant from the sensor, and upon the distance exceeding a limit, the seat back sensor transmits a signal to the actuator, whereupon the actuator moves the seat to the inclined position.

3. A toilet as described in claim 1, further comprising:

a crossbar positioned between the pair of spaced apart arms; and a crossbar sensor;

wherein, in use, movement of the crossbar is detected by the crossbar sensor and the crossbar sensor transmits an audible signal or visual signal to a location that is remote from the toilet.

4. A toilet as described in claim 1, wherein the first pressure sensor senses downward pressure on the first arm and the second pressure sensor senses downward pressure on the second arm, and upon the first pressure sensor or the second pressure sensor sensing downward pressure, transmitting the signal to the actuator.

5. A toilet as described in claim 1, wherein a pressure sensor senses rearward pressure on the first arm and an additional pressure sensor senses rearward pressure on the second arm, and upon sensing rearward pressure, transmitting the signal to the actuator.

6. A toilet as described in claim 1, wherein the seat is hinged in the front portion of the seat.

7. A toilet as described in claim 1, wherein the actuator is powered by air pressure.

8. A toilet as described in claim 1, wherein the actuator is powered by hydraulic pressure.

9. A toilet as described in claim 1, wherein the actuator is electrically powered.

10. A toilet as described in claim 1, wherein the actuator moves the seat to the inclined position by moving the rear portion of the seat to a position that is lower than the front portion of the seat upon the actuator receiving the signal.

11. A toilet as described in claim 1, wherein the actuator moves the seat to an inclined position wherein the rear portion of the seat is higher than the front portion of the seat upon the actuator receiving a signal to move the seat to an inclined position wherein the rear portion of the seat is higher than the front portion of the seat.

12. A toilet, the toilet comprising:

a seat having an opening therein;

a seat back connected to the seat;

a pair of spaced apart arms positioned above the seat and connected to the seat back;

an actuator that moves the seat to an inclined position wherein a rear portion of the seat is lower than a front portion of the seat upon the actuator receiving a signal;

a crossbar positioned between the pair of spaced apart arms; and a crossbar sensor;

wherein, in use, movement of the crossbar is detected by the crossbar sensor and the crossbar sensor transmits the signal to the actuator, whereupon the actuator moves the seat to the inclined position.

13. A toilet as described in claim 12, further comprising a seat back sensor positioned in the seat back, wherein, in use, the seat back sensor detects a change in distance of an occupant from the sensor, and upon the distance exceeding a limit, the seat back sensor transmits a signal to the actuator, whereupon the actuator moves the seat to the inclined position.

14. A toilet as described in claim 12, wherein the actuator moves the seat to the inclined position by moving the rear portion of the seat to a position that is lower than the front portion of the seat upon the actuator receiving the signal.

15. A toilet as described in claim 12, wherein movement of the crossbar is detected by the crossbar sensor and the crossbar sensor transmits an audible signal or visual signal to a location that is remote from the toilet.

16. A toilet as described in claim 12, wherein the actuator moves the seat to an inclined position wherein the rear portion of the seat is higher than the front portion of the seat upon the actuator receiving a signal to move the seat to an inclined position wherein the rear portion of the seat is higher than the front portion of the seat.

* * * * *